US006824020B1

(12) United States Patent
Petit

(10) Patent No.: US 6,824,020 B1
(45) Date of Patent: Nov. 30, 2004

(54) DISPENSING HEAD AND FLUID PRODUCT DISPENSING DEVICE COMPRISING SAME

(75) Inventor: Ludovic Petit, Vitot (FR)

(73) Assignee: Valois S.A., Le Neubourg (FR)

( * ) Notice: Subject to any disclaimer, the term of this patent is extended or adjusted under 35 U.S.C. 154(b) by 172 days.

(21) Appl. No.: 09/980,631

(22) PCT Filed: Jun. 5, 2000

(86) PCT No.: PCT/FR00/01535

§ 371 (c)(1),
(2), (4) Date: Dec. 5, 2001

(87) PCT Pub. No.: WO00/76567

PCT Pub. Date: Dec. 21, 2000

(30) Foreign Application Priority Data

Jun. 10, 1999 (FR) ..... 99 07311

(51) Int. Cl.[7] ..... B65D 88/054

(52) U.S. Cl. ..... 222/321.6; 222/321.6; 222/321.8; 128/203.22

(58) Field of Search ..... 222/321.6, 321.8; 128/203.22

(56) References Cited

U.S. PATENT DOCUMENTS

| | | | | | |
|---|---|---|---|---|---|
| 4,944,429 | A | * | 7/1990 | Bishop et al. | 222/153.13 |
| 5,031,800 | A | * | 7/1991 | Brunet | 222/153.06 |
| 5,147,073 | A | * | 9/1992 | Cater | 222/321.9 |
| 5,411,181 | A | * | 5/1995 | Knickerbocker | 222/309 |
| 6,234,365 | B1 | * | 5/2001 | Bougamont et al. | 222/494 |
| 6,443,370 | B1 | * | 9/2002 | Brulle et al. | 239/333 |

* cited by examiner

*Primary Examiner*—Gene Mancene
*Assistant Examiner*—Melvin A. Cartagena
(74) *Attorney, Agent, or Firm*—Sughrue Mion, PLLC

(57) ABSTRACT

A dispenser head for a dispenser device for dispensing a fluid, said dispenser head being characterized in that it comprises an inner body (10) defining a dispensing channel (11) for the fluid, said channel (11) being terminated by a dispensing orifice (12), and a separate outer body (20) defining an actuating surface (21) on which the user presses to actuate the dispenser device, said outer body (20) being fitted over said inner body (10) in a manner such that, in the event that an attempt is made to tear off or to remove said dispenser head, only said outer body (20) is removable, said inner body (20) remaining fixed to said dispenser device.

15 Claims, 3 Drawing Sheets

DISPENSING HEAD AND FLUID PRODUCT DISPENSING DEVICE COMPRISING SAME

FIELD OF THE INVENTION

The present invention relates to an improved dispenser head and to a fluid dispenser device including such a head.

BACKGROUND OF THE INVENTION

Fluid dispenser devices are well known, and such a device generally comprises a reservoir, a dispenser member, such as a pump or a valve, mounted on said reservoir, and a dispenser device making it possible to actuate the pump and thus to dispense the fluid contained in the reservoir. The head is generally fixed to the moving actuating rod for actuating the pump, and it defines an expulsion channel leading to a dispensing orifice making it possible to dispense the fluid.

Known dispenser heads can suffer from certain disadvantages. In the event that the pusher is removed or torn off accidentally or improperly from its position as mounted on the pump, the fluid contained in the pump or in the reservoir might become contaminated. Furthermore, since the pusher is the last part of the fluid dispenser device to be assembled, it is desirable to make the last assembly step as simple as possible. The manufacturer of the fluid to be dispensed is generally not the manufacturer of the dispenser device, so that, after the reservoir has been filled, it is necessary firstly to mount the pump on the reservoir, and then to mount the dispenser head on the pump. Therefore, the pump and the dispenser head are generally delivered separately, and assembled on the site of the manufacturer of the fluid. In which case, it can be difficult to avoid all risk of contamination while the head is being assembled on the pump, and that assembly requires complicated tools.

Another problem that can arise with dispenser heads, in particular dispenser heads of the nasal applicator type, concerns manufacture and assembly of the dispenser head itself. In particular in spray uses, it is generally necessary to form a spray profile at the dispensing orifice. Unfortunately, in particular in devices of the nasal applicator type, the end of the head provided with the dispensing orifice is relatively remote from the injection point of the mold, which makes it difficult to form the spray profile and to achieve accuracy in forming it.

Similarly, it can be desirable to avoid any risk of the dispenser head being removed, to prevent the user from attempting various undesired operations, such as refilling the reservoir, for example.

Furthermore, in particular when the dispenser head is used as the pusher of a nasal applicator, it is important for it to be possible to clean the dispenser head, without however any risk of polluting the working portion of the pump, and in particular the fluid contained therein.

Documents DE-14 91 714, U.S. Pat. No. 4,830,224, and DE-41 10 304 disclose dispenser heads or pushers made up from more than one piece, but none of them makes it possible to prevent the piece incorporating the dispensing orifice from being torn off, so that the fluid is contaminated if any attempt is made to tear off the pusher.

SUMMARY OF THE INVENTION

An object of the present invention is to provide a dispenser head and a fluid dispenser device incorporating such a dispenser head that do not reproduce the above-mentioned drawbacks.

In particular, an object of the present invention is to provide a dispenser head that prevents any risk of contaminating the fluid.

Another object of the present invention is to provide such a dispenser head that is simple and inexpensive to manufacture and to assemble.

Yet another object of the present invention is to provide such a dispenser head for which the final stage of assembly of the fluid dispenser device is simplified, in particular when the manufacturer of the fluid to be dispensed is different from the manufacturer of the dispenser device.

Yet another object of the present invention is to provide a dispenser head that prevents said head from being torn off or removed from the dispenser device after it has been assembled.

Another object of the present invention is to provide such a dispenser head that is easy to clean without affecting the working portion of the pump in any way.

The present invention thus provides a dispenser head for a fluid dispenser device for dispensing a fluid, said dispenser head comprising an inner body defining a dispensing channel for the fluid, said channel being terminated by a dispensing orifice, and a separate outer body defining an actuating surface on which the user presses to actuate the dispenser device, said outer body being fitted over said inner body in a manner such that, in the event that an attempt is made to tear off or to remove said dispenser head, only said outer body is removable, said inner body remaining fixed to said dispenser device.

Advantageously, the inner body has an outside radial shoulder co-operating with a corresponding inside radial shoulder of the outer body to define the assembled position of the head.

Advantageously, the outer body is a push fit on the inner body.

In an advantageous variant embodiment, the head is in the form of a pusher for a nasal applicator, the pusher comprising a frustoconical elongate portion designed to penetrate in part into the nostril, and a wider portion forming the actuating surface.

In a first embodiment, the outer body incorporates the frustoconical portion and the wider portion.

In a second embodiment, the inner body incorporates the frustoconical portion, and the outer body incorporates the wider portion.

Preferably, the inner body comprises a hollow tubular member, and a frustoconical skirt extending around said tubular member to form said frustoconical portion, the free end of said skirt incorporating a radial shoulder for co-operating with the outer body.

The free end of said frustoconical skirt is provided with a sharp edge at its axial end surface.

Advantageously, the inner body is provided with fixing means, such as snap-fastening means, for fixing to said dispenser device.

The present invention also provides a fluid dispenser device comprising a fluid reservoir, and a dispenser member such as a pump, said fluid dispenser device further comprising a dispenser head of the present invention.

Preferably, said inner body of the head is snap-fastened to the actuating rod of the pump so that, in the event that an attempt is made to tear off or remove the head, the inner body remains fixed to said pump, thereby preventing any contamination of the fluid contained in the reservoir.

Advantageously, said inner body of the head is provided with closure means at the dispensing orifice.

BRIEF DESCRIPTION OF THE DRAWINGS

Other characteristics and advantages of the present invention appear more clearly from the following detailed description of embodiments of the present invention, given by way of non-limiting example and with reference to the accompanying drawings, in which.

DETAILED DESCRIPTION OF PREFERRED EMBODIMENT OF THE INVENTION

All of the embodiments shown in the figures more particularly concern dispenser heads of the nasal applicator pusher type. Naturally, the present invention is not limited to this particular type of dispenser head.

Figure 1:
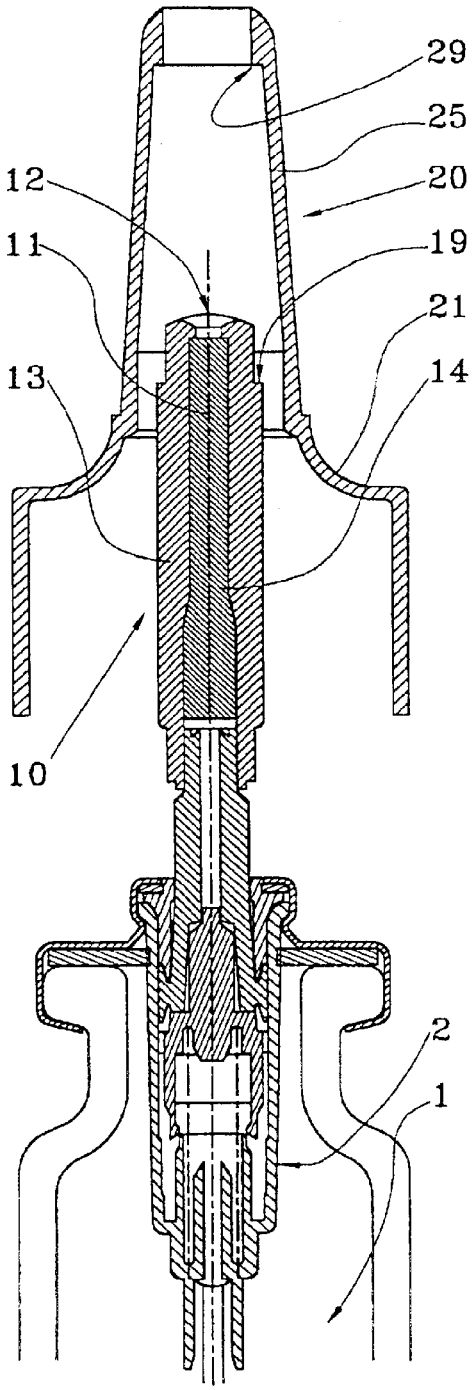
FIG. 1 is a diagrammatic section view of a fluid dispenser device incorporating a dispenser head of the invention, in the disassembled state.
Figure 2:
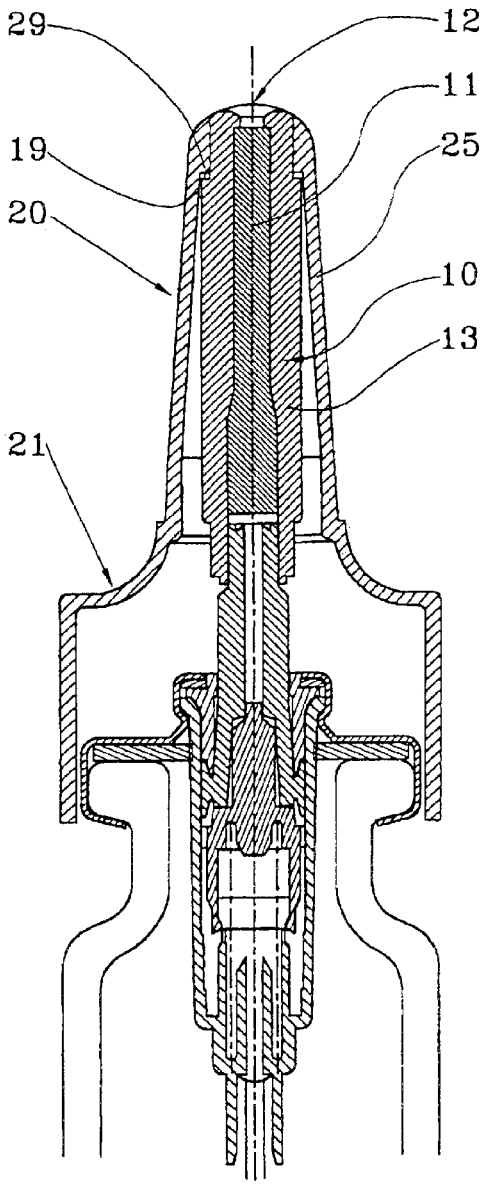
FIG. 2 is a view similar to the FIG. 1 view, in the assembled state.

FIGS. 1 and 2 show an embodiment of the dispenser head of the present invention respectively in the nonassembled position and in the assembled position, the dispenser head co-operating with a pump 2 mounted on a reservoir 1 to form a fluid dispenser device. The reservoir and the pump may be of any type, and, in place of a pump, it is equally possible to use a valve, such as a metering valve. The particular components of the dispenser head are therefore not described any more fully below.

The dispenser head of the invention includes an inner body 10 defining a dispensing channel 11 for the fluid. In the example shown in FIG. 1, said inner body 10 is connected to the actuating rod of the pump, preferably in leaktight manner. The expulsion channel 11 is terminated by a dispensing orifice 12 which is thus part of the inner body 10. As shown in FIG. 1, the inner body 10 may be pre-assembled on the pump 2, in particular on the site of the manufacturer of said pump. The head further includes an outer body 20 which defines an actuating surface 21, which, in the examples shown in the drawings, is a finger-receiving press zone on which the user presses to actuate the dispenser device. The outer body 20 is fitted over the inner body 10 as shown in FIG. 2, preferably as a push fit, so that, if an attempt is made to tear off said dispenser head, only said outer body 20 is removable, while the inner body 10 remains fixed to said dispenser device, which, in this example, is the pump 2.

Figure 4:
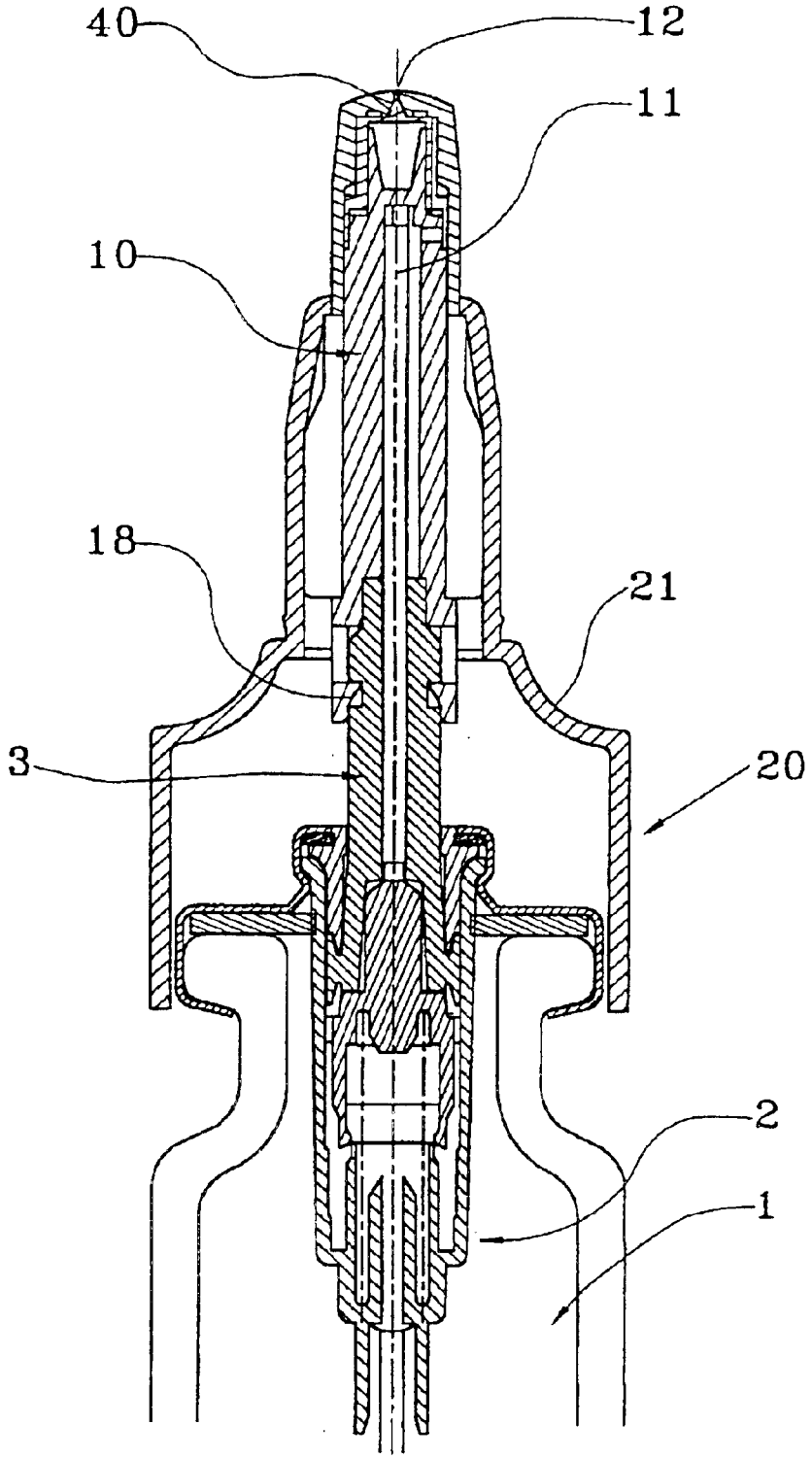
FIG. 4 is a diagrammatic section view of another variant embodiment of the present invention.

The inner body 10 may be secured firmly to the pump as a tight fit, or, as shown in FIG. 4, by means of a snap-fastening system 18 whereby the bottom end of the inner body 10 is snap-fastened to the actuating rod 3 of the pump 2.

Figure 3:
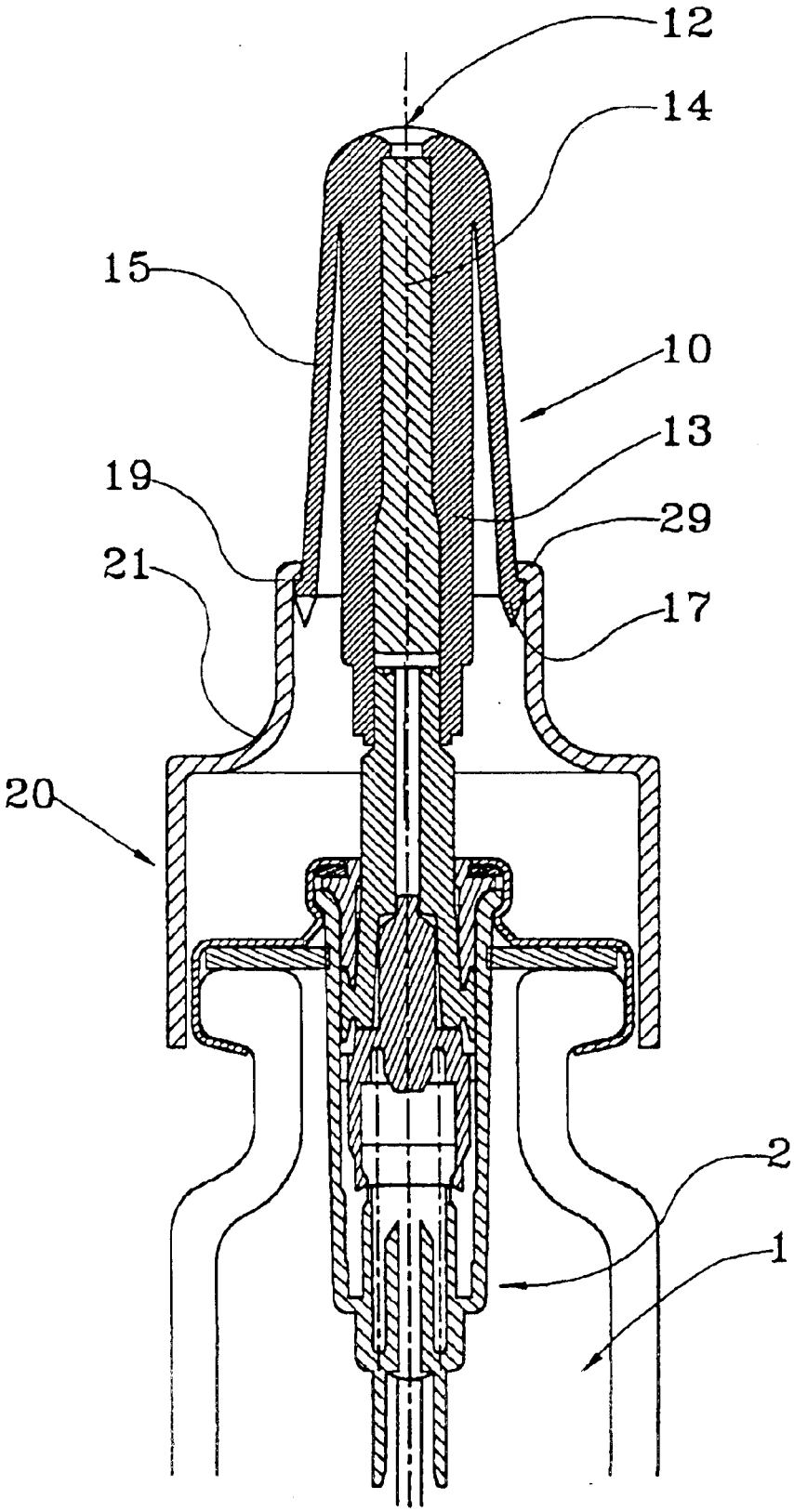
FIG. 3 is a view similar to the FIG. 2 view, showing a variant embodiment of the invention.

Preferably, the inner body 10 is provided with an outside radial shoulder 19 which co-operates with a corresponding inside radial shoulder 29 in the outer body 20 to define an assembled position for the head, as shown in FIGS. 2 and 3.

With reference more particularly to the embodiment of the pusher for a nasal applicator as shown in the figures, the pusher typically comprises a frustoconical elongate portion which is designed to penetrate in part into the nostril, and a wider portion which forms the actuating surface. In a first variant embodiment shown in FIGS. 1 and 2, the outer body 20 incorporates the frustoconical portion 25 and the wider portion 21. In which case, the inner body 10 is constituted by a hollow tubular element 13, in which it is optionally possible to dispose a spray insert 14 as shown in FIG. 4. If an attempt is made to remove or to disassemble the pusher, only the outer body 20 is removed while the inner body 10 remains fixed to the pump, thereby preventing any contamination of the fluid contained in the reservoir, or in the pump, while also making the pusher easy to clean.

FIG. 3 shows a variant in which the inner body 10 incorporates the frustoconical portion 15 while the outer body 20 incorporates the wider portion 21 forming the actuating zone. In this example, in addition to including the hollow tubular member 13, the inner body 10 also includes a frustoconical skirt 15 which extends around said tubular member 13 to form said frustoconical portion. Advantageously, the free end of said skirt 15, i.e. the bottom end in the drawings, is provided firstly with the radial shoulder 19 which co-operates with the outer body 20, and secondly with a sharp edge 17 at its axial end surface to form a spiky anti-tear-off zone.

FIG. 4 shows yet another variant, in which, as mentioned above, the inner body 10 is snap-fastened on the rod 3 of the pump 2, and said inner body 10 incorporates closure means 40 disposed upstream from the dispensing orifice 12, thereby guaranteeing excellent leaktightness over the entire fluid outlet path from the reservoir 1 to the dispensing orifice.

The dispenser head of the present invention procures the following advantages:

- by means of its two-piece structure, it makes it possible for the outer piece only to be removed while the inner piece which incorporates the dispensing orifice is held on the pump, thereby avoiding any risk of contamination, or of refilling, etc., while also making it easy for said dispenser head to be cleaned thoroughly;
- the head being made in two pieces makes it possible for the inner body to be pre-assembled on the pump on the site of the manufacturer of the pump, which greatly facilitates assembly on the site of the manufacturer of the fluid to be dispensed, in particular if the fluid manufacturer is different from the dispenser device manufacturer;
- the head being made in two pieces greatly facilitates the forming of the spray profile in the dispenser device, it being possible for the inner body to be made in a tubular form in which it is very easy to provide such a profile, unlike the nasal applicator heads of the state of the art that are made in one piece, in which, because of the curvature necessary at the end of the pusher, problems of wall thickness are posed that make it difficult to form said spray profile; in the present case, such problems are not posed since the rounded shape of the end of the head may be formed on the outer body that is assembled subsequently on the inner body; and molding the head, in particular molding the inner body and the outer body, is facilitated compared with molding the head in a single piece.

Naturally, the examples described above with reference to the accompanying drawings are given merely by way of non-limiting example, and do not limit the scope of the invention as defined by the accompanying claims.

What is claimed is:

1. A dispenser head for a fluid dispenser device for dispensing a fluid, said dispenser head being characterized in that it comprises an inner body (10) defining a dispensing channel (11) for the fluid, said channel (11) being terminated by a dispensing orifice (12), and a separate outer body (20) defining an actuating surface (21) on which the user presses to actuate the dispenser device, said inner body (10) incorporating said dispensing orifice (12) being fixed in non-removable manner to a stem of said dispenser device and said outer body (20) being fitted over said inner body (10) in removable manner such that, in the event that an attempt is made to tear off or to remove said dispenser head, only said outer body (20) is removable, said inner body (20) remaining fixed to said dispenser device.

2. A head according to claim 1, in which the inner body (10) has an outside radial shoulder (19) co-operating with a corresponding inside radial shoulder (29) of the outer body (20) to define the assembled position of the head.

3. A head according to claim 1, in which the outer body (20) is a push fit on the inner body (10).

4. A head according to claim 1, in the form of a pusher for a nasal applicator, the pusher comprising a frustocorical elongate portion (15, 25) designed to penetrate in part into the nostril, and a wider portion (21) forming the actuating surface.

5. A head according to claim 4, in which the outer body (20) incorporates the frustoconical portion (25) and the wider portion (21).

6. A head according to claim 4, in which the inner body (10) incorporates the frustoconical portion (15), and the outer body (20) incorporates the wider portion (21).

7. A head according to claim 6, in which the inner body (10) comprises a hollow tubular member (13), and a frustoconical skirt (15) extending around said tubular member (13) to form said frustoconical portion, the free end of said skirt (15) incorporating a radial shoulder (19) for co-operating with the outer body (20).

8. A head according to claim 7, in which the free end of said frustoconical skirt (15) is provided with a sharp edge (17) at its axial end surface.

9. A head according to claim 1, in which the inner body (10) is provided with fixing means (18), such as snap-fastening means, for fixing to said dispenser device.

10. A fluid dispenser device comprising a fluid reservoir (1), and a dispenser member (2) such as a pump, said fluid dispenser device being characterized in that it further comprises a dispenser head according to claim 1.

11. A fluid dispenser device according to claim 10, in which said inner body (10) of the head is snap-fastened to an actuating rod (3) of the pump (2) so that, in the event that an attempt is made to tear off or remove the head, the inner body (10), together with the closure means (40), remains fixed to said pump (2), thereby preventing any contamination of the fluid contained in the reservoir (1).

12. A fluid dispenser device according to claim 10, in which said inner body (10) of the head is provided with closure means (40) at the dispensing orifice (12).

13. A dispenser head for a fluid dispenser device for dispensing a fluid, comprising:

an inner body (10) defining a dispensing channel (11) for the fluid, said channel (11) being terminated by a dispensing orifice (12) that defines a spray profile; and an outer body (20), distinct and coupled to the inner body, defining an actuating surface (21) on which a user presses to actuate the dispenser device;

wherein the inner body (10) is fixed to a stem of the dispenser device and the outer body (20) is fitted over the inner body (10) in a removable non-frangible manner such that the inner body cannot be simultaneously removed from the fluid dispenser device with the outer body.

14. The fluid dispenser device according to claim 13, wherein the inner body (10) is fixed in a non-removable manner to the dispenser device so that in the event that an attempt is made to tear off or to remove the dispenser head, only the outer body (20) is removable, the inner body (20) remaining fixed to said dispenser device.

15. A dispensing device, comprising:

a reservoir;

a pump; and a dispenser head for dispensing fluid from the reservoir;

wherein the dispenser head comprises an inner body (10) defining a dispensing channel (11) for the fluid, the channel (11) being terminated by a dispensing orifice (12); and a separate outer body (20) defining an actuating surface (21) on which the user presses to actuate the dispenser device; and wherein the inner body (10) comprises the dispensing orifice (12) and is fixed in a non-removable manner to the pump and the outer body (20) is fitted over the inner body (10) in a removable manner such that, in the event that an attempt is made to tear off or to remove the dispenser head, only the outer body (20) is removable, said inner body (20) remaining fixed to the pump.

* * * * *